US005299794A

United States Patent [19]

Yamada et al.

[11] Patent Number: 5,299,794

[45] Date of Patent: * Apr. 5, 1994

[54] IMAGE FORMING DEVICE HAVING A PLURALITY OF COPY MATERIAL FEEDING MEMBERS

[75] Inventors: Yoshikado Yamada, Kashihara; Yoshiteru Mori, Nara; Toshihisa Matsuo, Yamatokoriyama, all of Japan

[73] Assignee: Sharp Kabushiki Kaisha, Osaka, Japan

[ * ] Notice: The portion of the term of this patent subsequent to Dec. 21, 2010 has been disclaimed.

[21] Appl. No.: 769,753

[22] Filed: Oct. 3, 1991

Related U.S. Application Data

[63] Continuation of Ser. No. 518,651, May 3, 1990, abandoned.

[30] Foreign Application Priority Data

May 9, 1989 [JP] Japan ..... 1-116438

[51] Int. Cl.[5] ..... B65H 3/44

[52] U.S. Cl. ..... 271/9; 271/162

[58] Field of Search ..... 271/9, 127, 145, 157, 271/162, 164, 171, 241, 253-255, 265

[56] References Cited

U.S. PATENT DOCUMENTS

| | | | |
|---|---|---|---|
| 4,763,889 | 8/1988 | Dei et al. | 271/9 |
| 4,809,050 | 2/1989 | Ito | 271/9 |
| 4,958,822 | 9/1990 | Rutishauser et al. | 271/9 |
| 5,003,493 | 3/1991 | Okada et al. | 271/162 X |

FOREIGN PATENT DOCUMENTS

| | | | |
|---|---|---|---|
| 0156357 | 10/1985 | European Pat. Off. . | |
| 56-59245 | 5/1981 | Japan . | |
| 59-123859 | 7/1984 | Japan . | |
| 262735 | 12/1985 | Japan | 271/145 |
| 145049 | 7/1986 | Japan | 271/9 |
| 192637 | 8/1986 | Japan | 271/9 |
| 82250 | 4/1988 | Japan | 271/9 |

*Primary Examiner*—D. Glenn Dayoan
*Assistant Examiner*—Boris Milef
*Attorney, Agent, or Firm*—Birch, Stewart, Kolasch & Birch

[57] ABSTRACT

A copy material feeding device in accordance with the present invention includes at least one rotatable cassette having a copy material orientation changing device for shifting copy material thereon in at least two feeding positions from which the copy paper is fed; and at least one fixed cassette without the copy material orientation changing device. The feeding device has an arrangement wherein the rotatable cassette is disposed in such a position that a transport path from the rotatable cassette to the copying apparatus is allowed to be shorter than that from the fixed cassette to the copying apparatus. Accordingly, with respect to copy paper of a predetermined size stored in the rotatable cassette, both lateral and longitudinal feeds are performed by way of the shortest transport path, that is, in a minimized transport time, and therefore the arrangement permits the copy paper to be transported to the copying machine at high speeds.

3 Claims, 4 Drawing Sheets

IMAGE FORMING DEVICE HAVING A PLURALITY OF COPY MATERIAL FEEDING MEMBERS

This application is a continuation of application Ser. No. 07/518,651 filed on May 3, 1990, now abandoned.

BACKGROUND OF THE INVENTION

1. Field of the Invention

The present invention relates to a copy material feeding device which is provided for copying machines, laser printers, over-head projectors and other apparatuses.

2. Description of the Related Art

A copying machine, which is an example of apparatuses requiring copy material feed, is designed to be fed copy material (for example, copy paper: hereinafter called paper) by a copy material feeding device (hereinafter called paper feed device) which is normally installed inside or outside of the apparatus. The paper feed device comprises a plurality of copy material feeding members (for example, such as paper feed cassettes: hereinafter given an explanation referring to paper feed cassettes) classified by each size of paper, and paper of the selected size is fed to the device from the corresponding paper feed cassette. For conveying the paper from the paper feed device, lateral feed where the transport direction coincides with the crosswise direction of the copy paper, is preferred in terms of transport speed to longitudinal feed where the transport direction coincides with the lengthwise direction of the paper. Some of the paper feed devices provided in copying machines can transport paper of a large size such as B4 or even A3 in the lateral feed.

However, feeding large size paper laterally causes the photosensitive drum, the transport rollers, the transport paths of the paper, and other parts inside the copying machine to become large. As a result, the copying machine itself tends to become bulky, and its cost tends to rise. Hence generally, the method of longitudinally feeding laterally paper of a large size such as A3 or B4, and feeding paper of a size not larger than A4 is adopted.

However, in a copying machine with a variable magnification function that performs reductions and enlargements, paper is generally transported longitudinally. Accordingly, for feeding paper of a size not larger than A4, paper feed cassettes that feed the paper longitudinally are necessary to perform reduced copies (those cassettes are generally denoted by A4R and B5R). Moreover, when thinking of transport speed, A4 and B5 paper feed cassettes that feed the paper laterally are also necessary (those cassettes are simply denoted by A4 and B5). Accordingly, when it comes to installing those different types of paper feeding cassettes, the arrangement causes the size of the copying machine to be large and its cost to rise. When trying to avoid having a bulky device, a problem is presented in that a complicated operation is necessary because of having to change a plurality of the paper feed cassettes as occasion calls.

Therefore, copying machines designed to solve the above problems have been disclosed in Japanese Patent Publication (laid-open) No. 59245/1981 and No. 123859/1984 (Tokukaisho 56-59245 and 59-123859), wherein the same paper feeding cassette is commonly used, for example, for both B5 and B5R or for both A4 and A4R, and by rotating the feeding position of copy paper in the paper feeding cassette, the arrangement permits the copy paper to be shifted either in lateral or longitudinal feeding positions.

However, the conventional arrangement has a problem in that a more appropriate arrangement has not been achieved in terms of a positional relationship between the rotatable cassette (capable of rotating and shifting itself either in a lateral feeding position to feed paper laterally or in a longitudinal feeding position to feed paper longitudinally) and the fixed cassette whose feeding position is fixed either in lateral or longitudinal feeding positions, and by achieving the appropriate arrangement, the transport time of the paper is expected to be further minimized.

SUMMARY OF THE INVENTION

It is an object of the present invention to provide a copy material feeding device which has a minimum length of paper transport path from a copy material feeding member having copy material orientation changing means with respect to its transport direction to the copying apparatus.

In order to achieve the above object, a copy material feeding device of the present invention is characterized in that a copy material feeding member with copy material orientation changing means is disposed in such a position in the device that the arrangement is able to make a transport path from the copy material feeding member with the copy material orientation changing means to the copying apparatus shorter than that from a copy material feeding member without the copy material orientation changing means to the copying apparatus.

With the above arrangement, regardless of its lateral or longitudinal feed, the copy paper stored in the copy material feeding member with the copy material orientation changing means is transported to the copying apparatus in a shorter transport time than that required for the copy paper stored in the copy material feeding member without the copy material orientation changing means. Accordingly, by storing copy material generally used most frequently (for example, copy paper such as size B5 or A4) in the copy material feeding member with the copy material orientation changing means, the transport time of the copy material most frequently used can be shortened. Therefore, the arrangement makes it possible to increase a copying speed for the first sheet of copy paper when the copy paper in the copy material feeding member with the copy material orientation changing means is selected to perform a copying operation. As a result, a better operability of the copying machine can be obtained by using the device of the present invention.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a front view showing the whole structure of a copying machine comprising a paper feeding device of the present invention;

FIG. 2(*a*) is a partial sectional perspective view showing the structure of first and second rotatable sections 26, 27;

FIG. 2(*b*) is an enlarged perspective view showing a nut member shown in FIG. 4(*a*) and the periphery thereof;

FIG. 3 is a block diagram showing the structure of a control device of the copying machine shown in FIG. 1; and FIG. 4 is an explanatory diagram showing the rotating process of a rotating section.

DESCRIPTION OF THE EMBODIMENTS

The following description will discuss one embodiment of the present invention referring to FIGS. 1 through 4.

Figure 1:
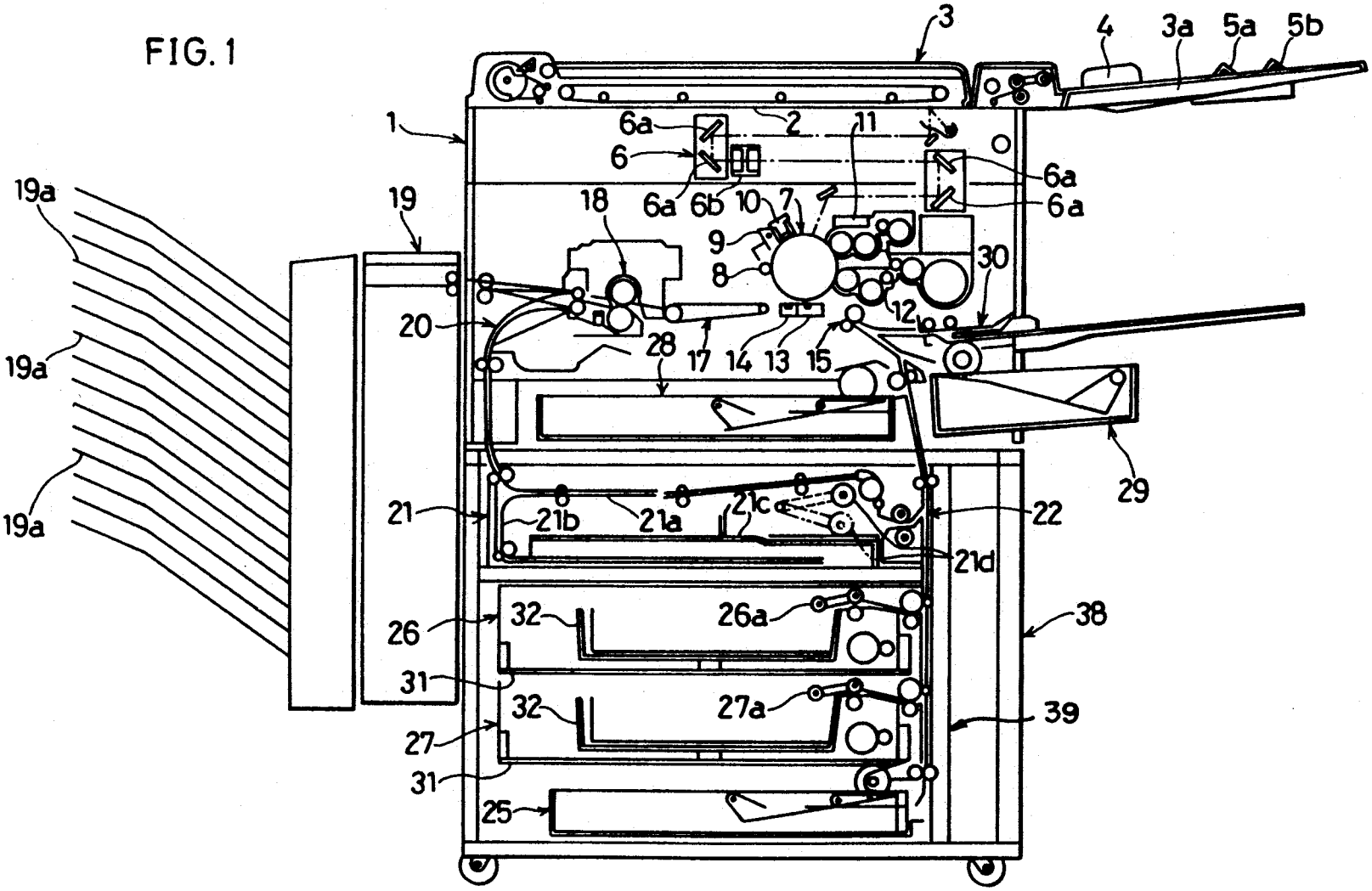
FIGS. 1 to 4 show one embodiment of the present invention.

As shown in FIG. 1, a copying machine 1, which comprises paper feed devices installed therein, is able to store more kinds of copy material (hereinafter referring to copy paper as an example) by installing a paper feed device 39 of the present invention as a copy material feeding device. A paper feed device 39 comprises a desk part 38 to be housed therein, and is capable of holding a copying machine thereon. Moreover, in the case of copying multiple sheets of copy paper, a sorter 19 is adaptable to the copying machine at the paper discharging side thereof so as to automatically classify or sort sheets of copy paper, and an automatic document feeder 3 (hereinafter called ADF) is also adaptable to the copying machine 1 on a document glass plate 2 thereof.

The ADF 3 comprises functions for feeding documents (not shown) placed on a document placing tray 3*a* to a predetermined position on the document glass plate 2 one by one according to the size and the longitudinal or lateral feeding position thereof and for discharging the document outside after the copying operation has been completed. Furthermore, for example, in order to perform a duplex copying operation, it also comprises a function for turning over the document and conveying it to a predetermined position on the document glass plate 2 again and for discharging it outside after the duplex copying operation has been completed.

On the document placing tray 3*a*, there are installed feeding position detection switches 5*a*, 5*b* for detecting the size of a document in its feeding position and a guide 4 for guiding both sides of the document in its crosswise direction. On the guide 4, there are secured crosswise direction detection switches (not shown) for detecting the size of the document in its crosswise direction.

Under the document glass plate 2, there is disposed an optical system 6 comprising a plurality of reflecting mirrors 6*a* and lenses 6*b*. In addition to a basic function for leading an optical image of a document onto a photosensitive drum 7, the optical system 6 is designed to have a variable magnification function which permits not only full-size copying but also enlargement and reduction copying.

Around the photosensitive drum 7, there are disposed a cleaner 8, a charge eliminator 9, a main charger 10, a developing device 11 for storing toner for color copying and a developing device 12 for storing black toner. By the use of these means as well as the optical system 6, a sequence of operations with respect to the photosensitive drum 7, charging, exposure, developing, elimination of remaining toner and charge elimination is executed.

Under the photosensitive drum 7, are disposed a transfer charger 13 and a separating charger 14, and by the transfer charger 13, a toner image on the photosensitive drum 7 is transferred onto a copy paper which has been supplied onto the photosensitive drum 7, and then the copy paper is separated from the photosensitive drum 7 by the separating charger 14. The copy paper which has been separated is conveyed to a fixing device 18 by a conveyor belt 17, and then the toner image thereon is fixed by the fixing device 18 by applying heat and pressure.

Having passed through the fixing device 18, the copy paper is discharged onto a predetermined one of a plurality of copy receiving trays 19*a* by way of a sorter 19 in the normal course of operation. However, in the case of performing duplex copying or composite copying, the copy paper is led to a duplex/composite unit 21 in the desk part 38 after having passed through a paper returning path 20. More specifically, in the case of duplex copying, the copy paper is placed on an intermediate tray 21*c* with its toner-image side out after having passed through a first conveying path 21*a* in the duplex/composite unit 21, and then is sent to a paper transport path 22 by a delivery roller 21*d*. On the other hand, in the case of composite copying, the copy paper is conveyed to a second paper conveying path 21*b* in the duplex/composite unit 21, where the copy paper is conveyed reversely when the rear edge of the copy paper has been detected. The copy paper is then placed on the intermediate tray 21*c* with its toner-image side down after having passed through the first conveying path 21*a*, and is sent to the paper transport path 22 by a delivery roller 21*d*.

The paper transport path 22 is elongated in the vicinity of the photosensitive drum 7, and at the end thereof there is disposed a paper stopping roller 15 for synchronizing the delivery of the copy paper to the rotation of the photosensitive drum 7. Moreover, to the paper transport path 22, there are respectively connected the following paper feeding members in an ascending order from the bottom of the copying machine 1: a third fixed cassette 25 which is a normal copy material feeding member not having a copy material orientation changing means; a second rotatable cassette 27 and a first rotatable cassette 26 both of which are copy material feeding members having copy material orientation changing means respectively; the aforementioned duplex/composite unit 21; a second fixed cassette 28 and a first fixed cassette 29 both of which are originally installed in the copying machine 1; and a manual paper feeding unit 30. Each of these paper feeding means supplies appropriate copy paper depending on copying operations. The above third fixed cassette 25, first rotatable cassette 26, second rotatable cassette 27 and duplex/composite unit 21 are disposed in the paper feed device 39 of the present invention. Moreover, each of the fixed cassettes 25, 28, 29 and each of the rotatable cassettes 26, 27 is removably attached to the copying machine or the paper feed device 39. Furthermore, the most important characteristic of the paper feed device 39 according to the present invention is that the first and second rotatable cassettes 26, 27 are disposed in such positions that the paper transport path from each of the first and second rotatable cassettes 26, 27 to the copying machine 1 becomes shorter than the paper transport path from the third fixed cassette 25 to the copying machine 1, and the paper transport path for the first rotatable cassette 26 is designed to be the shortest.

Figure 2:
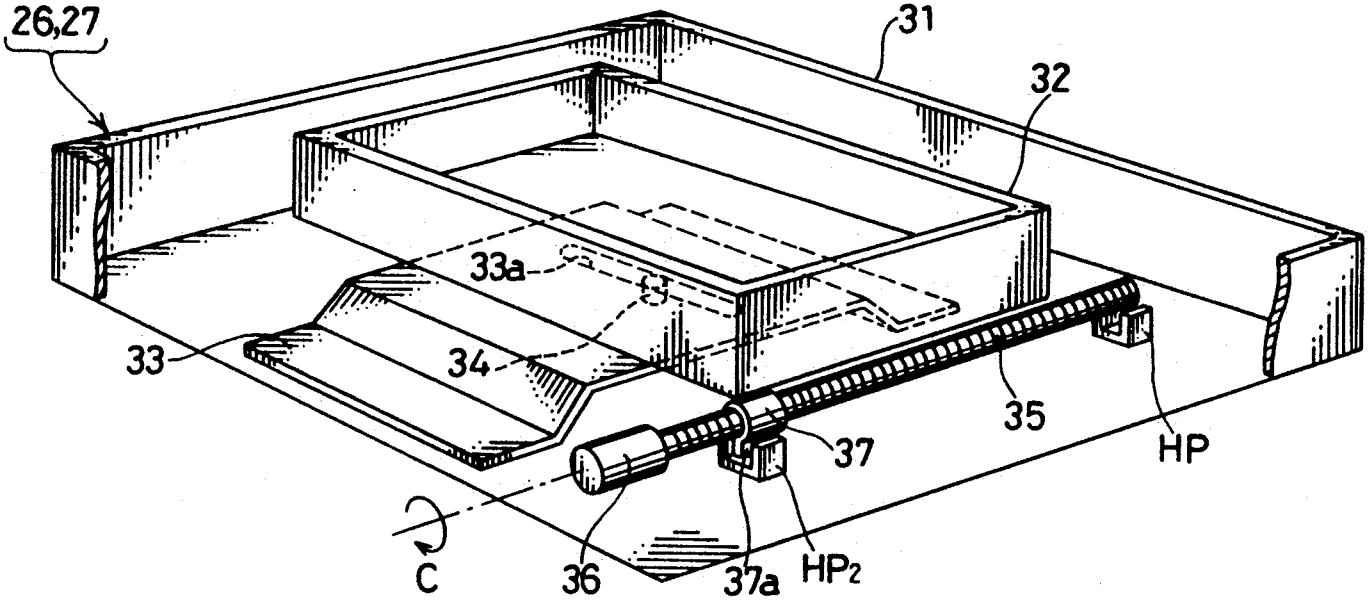
Figure 2:
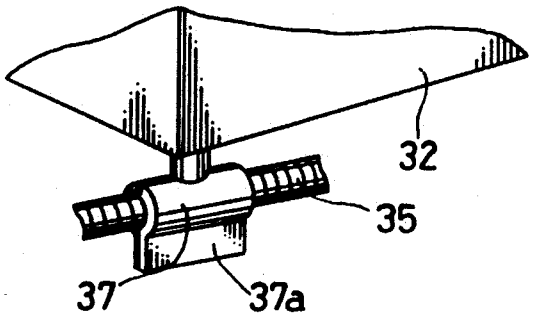

As shown in FIG. 2(*a*), the first and second rotatable cassettes 26, 27 are installed in respective outer boxes 31, and respectively comprise a rotatable section 32 (copy material orientation changing means) disposed in the outer box 31 for storing copy paper of a predetermined size. The rotatable section 32 comprises a pivotal copy material holding plate (not shown) for lifting up copy paper in the rotatable section 32 properly according to the reduction thereof. On the bottom of the outer box 31, is installed a rotatable section support plate 33 having a space to the bottom wall of the outer box 31 at the center part thereof. The rotatable section support plate 33 comprises a guiding hole 33*a* in the center thereof which has an elongated shape in the feeding direction of copy paper. In the center of the backside of the rotatable section 32, is secured a guiding shaft 34 protruding downward to be disposed within the guiding hole 33*a*.

Moreover, in the outer box 31, is installed a threaded shaft 35 at right angles to the feeding direction of the rotatable section 32 and parallel to the bottom wall of the outer box 31. The threaded shaft 35 is rotatably supported by bearings (not shown), and is coupled with a driving motor 36 at one end thereof, thereby being permitted to rotate either clockwise or counterclockwise. The threaded shaft 35 is adapted to engage a nut member 37 capable of making reciprocating movements along the threaded shaft 35 according to the clockwise or counterclockwise rotation of the threaded shaft 35. As shown enlarged in FIG. 2(*b*), the nut member 37 is rotatably connected to one corner of the rotatable section 32 at the upper end thereof. The nut member 37 further comprises a light interrupting part 37*a* at the lower part thereof.

On the other hand, below vicinity of the both ends of the threaded shaft 35 on the bottom wall of the outer box 31, there are installed a lateral position sensor $HP_1$ for detecting a state that the rotatable section 32 has been rotated to be set in a predetermined feeding position to feed copy paper laterally (hereinafter called lateral feeding position) according to the movement of the nut member 37 along the threaded shaft 35 and a longitudinal position sensor $HP_2$ for detecting a state that the rotatable section 32 has been set in a predetermined position to feed copy paper longitudinally (hereinafter called longitudinal feeding position). The lateral and longitudinal position sensors $HP_1$ and $HP_2$ respectively comprise a photointerrupter having a light emitting element and a light receiving element, and are designed to detect that the rotatable section 32 has been rotated to be set in the predetermined lateral or longitudinal position by the use of the fact that light being emitted from the light emitting element to the light receiving element is interrupted by the light interrupting part 37*a*. In addition, the lateral and longitudinal position sensors $HP_1$ and $HP_2$ are not limited to photointerrupters, but may be, for example, magnetic sensors, contact switches, or other devices.

Figure 3:
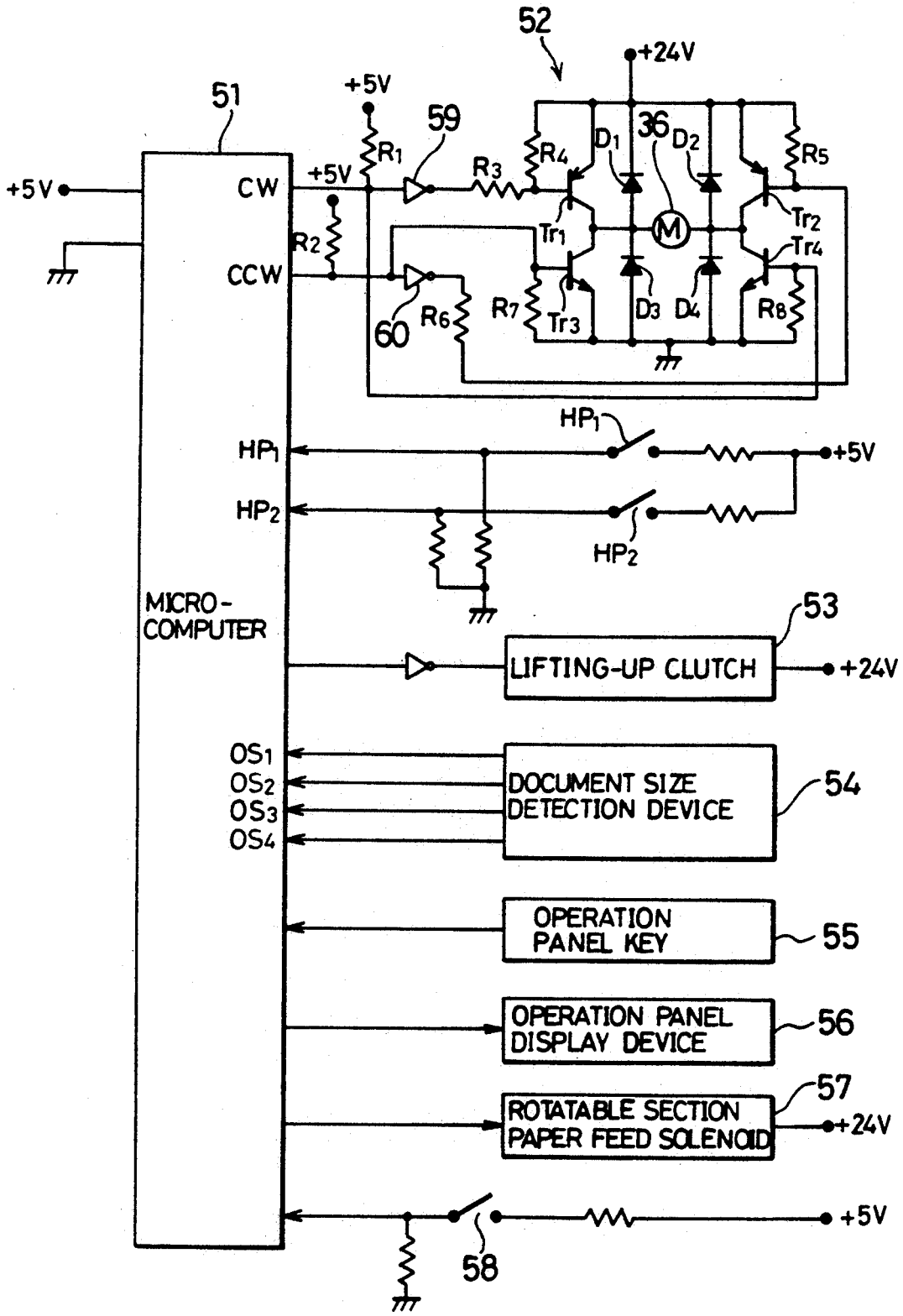
Figure 4:
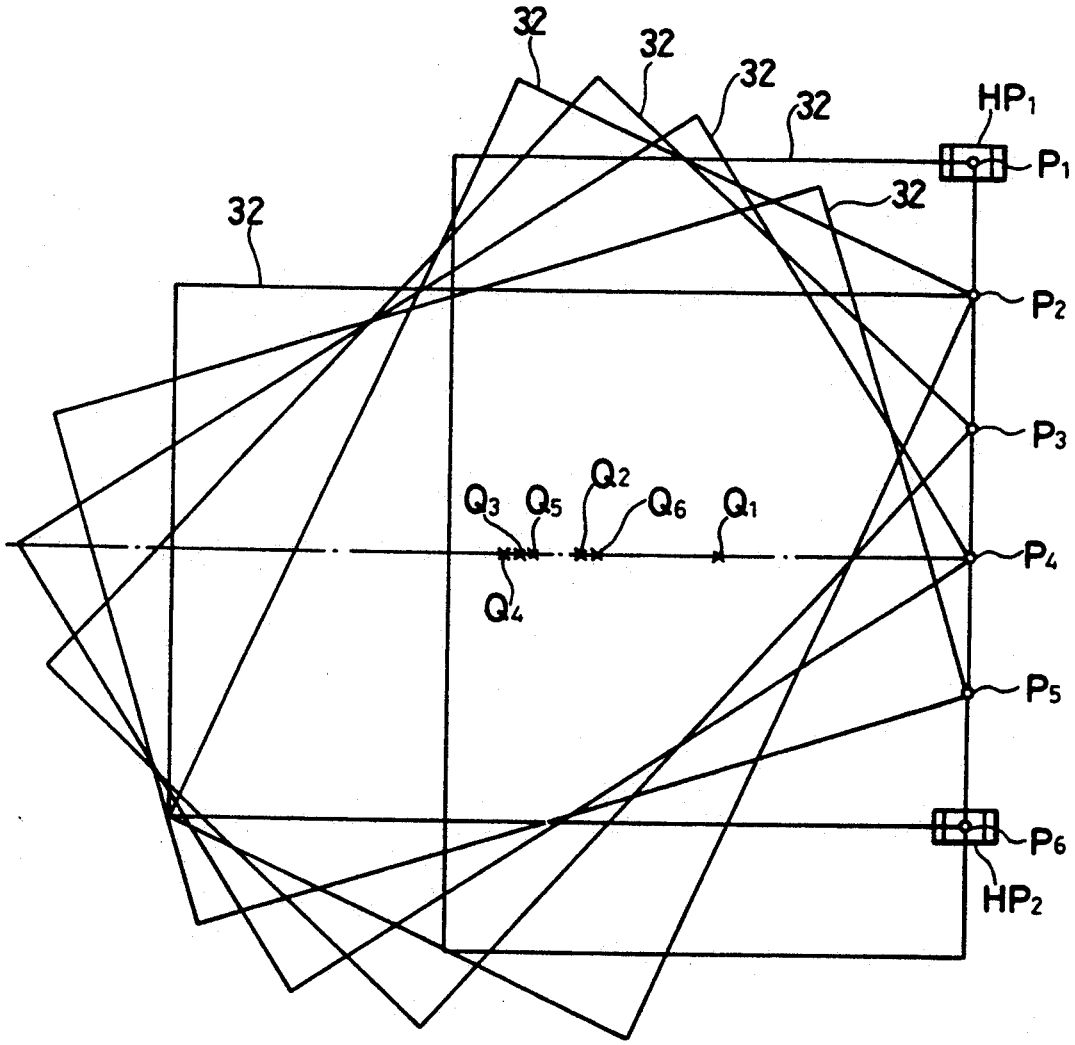

Moreover, as shown in FIG. 3, the copying machine 1 comprises a microcomputer 51 as a control means. To the microcomputer 51, there are connected a motor driver circuit 52 for driving the driving motor 36 (see FIG. 2(*a*)), the lateral and longitudinal position sensors $HP_1$, $HP_2$, lifting-up clutches 53, a document size detection device 54, operation panel keys 55, an operation panel display device 56, rotatable section paper feed solenoids 57, a paper entry detection switch 58 and other devices.

The motor driver circuit 52 and the driving motor 36, which are independently omitted in FIG. 3, are installed in each of the first rotatable cassette 26 and the second rotatable cassette 27. The motor driver circuit 52 comprises pull-up resistors $R_1$, $R_2$, NOT circuits 59, 60, transistors $Tr_1$ to $Tr_4$, resistors $R_3$ to $R_8$, and diodes $D_1$ to $D_4$ as surge suppressors, and drives the driving motor 36 to rotate either clockwise or counterclockwise in response to the output of the microcomputer 51. The pull-up resistor $R_1$, the input of the NOT circuit 59 and the base of the transistor $Tr_4$ are connected to an output terminal CW of the microcomputer 51, and the output of the NOT circuit 59 is connected to the base of the transistor $Tr_1$ through the resistor $R_3$. One end of the resistor $R_4$ is connected to the base of the transistor $Tr_1$, and that of resistor $R_5$ is connected to the base of the transistor $Tr_2$. The other ends of the resistors $R_4$ and $R_5$ are respectively connected to the emitters of the transistors $Tr_1$ and $Tr_2$, and are also respectively connected to the cathodes of the diodes $D_1$ and $D_2$. The connecting point of these ends is connected to the plus terminal of a power source, and a voltage of +24V is applied thereto. Moreover, the collector of the transistor $Tr_1$ and the anode of the diode $D_1$ are connected to one of the input terminals of the driving motor 36, and the collector of the transistor $Tr_2$ and the anode of the diode $D_2$ are connected to the other of the input terminals of the driving motor 36. On the other hand, the pull-up resistor $R_2$, the input of the NOT circuit 60 and the base of the transistor $Tr_3$ are connected to an output terminal CCW of the microcomputer 51, and the output of the NOT circuit 60 is connected to the base of the transistor $Tr_2$ through the resistor $R_6$. One end of the resistor $R_7$ is connected to the base of the transistor $Tr_3$, and one end of resistor $R_8$ is connected to the base of the transistor $Tr_4$. The other ends of the resistors $R_7$ and $R_8$ are respectively connected to the emitters of the transistors $Tr_3$ and $Tr_4$, and are also respectively connected to the anodes of the diodes $D_3$ and $D_4$. The connecting point of these ends are earthed. Moreover, the collector of the transistor $Tr_3$ and the cathode of the diode $D_3$ are connected to one of the input terminals of the driving motor 36, and the collector of the transistor $Tr_4$ and the cathode of the diode $D_4$ are connected to the other of the input terminals of the driving motor 36.

In the motor driver circuit 52, when the level of the output terminal CCW of the microcomputer 51 is high (while the level of the output terminal CW is kept low), the driving motor 36 is driven so that the rotatable section 32 is rotated to be set in the lateral feeding position (more specifically, for example, A4 or B5 is displayed on the operation panel display device 56). On the other hand, when the level of the output terminal CW is high, the driving motor 36 is driven reversely so that the rotatable section 32 is rotated to be set in the longitudinal feeding position (more specifically, for example, A4R or B5R is displayed on the operation panel display device 56).

The lifting-up clutch 53 is adapted to releasably transmit driving power to a lifting plate for lifting up a rotatable plate in the rotatable section 32.

The document size detection device 54 comprises crosswise-direction detection switches (not shown) secured on the guide 4 of the document placing tray 3*a* (see FIG. 1) and feeding position detection switches 5*a*, 5*b*, and is designed to supply data of 4 bits to the input terminals $OS_1$ to $OS_4$ of the microcomputer 51.

Operation panel keys 55 comprise a copy button for instructing the start of a copying operation, ten keys for setting the number of copies to be made and the like, rotation keys for entering instructions to rotate the rotatable section 32 of the rotatable cassette 26, 27 to be set from the lateral feeding position to the longitudinal feeding position and vice versa, and copy mode selection keys for selecting various copy modes among one side copying, duplex copying, composite copying or other modes, all of which are disposed on the operation panel of the copying machine 1.

The operation panel display device 56 displays the rotational positions of the rotatable cassettes 26, 27, the copy modes, the size as well as the lateral or longitudinal feeding position of copy paper stored in each of the cassettes 25 to 29, and other factors.

The rotatable section paper feed solenoid 57 permits pick-up rollers 26*a*, 27*a* (see FIG. 1) in the rotatable cassettes 26, 27 to perform a paper feed operation.

The paper entry detection switch 58 is disposed just before a paper stopping roller 15 (see FIG. 1), and is designed to detect the arrival of copy paper to the paper stop roller 15.

The microcomputer 51 is designed to perform control in response to each operation instructed by each the operation panel keys 55. For example, when the rotation key associated with the first rotatable cassette 26 or with the second rotatable cassette 27 is operated, and if the key operation instructs that the rotatable section 32 should be rotated from the lateral feeding position to the longitudinal feeding position thereof, the level of the output terminal CW is turned high, while the level of the output terminal CCW is kept low. When the longitudinal position sensor $HP_2$ has detected that the rotatable section 32 has been shifted to the longitudinal position (that is, light in the photointerrupter is interrupted), the microcomputer 51 immediately permits the level of the output terminal CW to become low and thereby the driving motor 36 to stop. On the other hand, if the key operation instructs that the rotatable section 32 should be rotated from the longitudinal feeding position to the lateral feeding position thereof, the level of the output terminal CCW is turned high, while the level of the output terminal CW is kept low. When the lateral position sensor $HP_1$ has detected that the rotatable section 32 has been shifted to the lateral position, the microcomputer 51 immediately permits the level of the output terminal CCW to become low and thereby the driving motor 36 to stop.

Furthermore, the microcomputer 51 has a function for selecting an appropriate cassette among fixed cassettes 25, 28, 29 and rotatable cassettes 26, 27 by judging the size of a document by data of 4 bits entered thereto from the document size detection device 54.

With the above arrangement, as shown in FIG. 1, in the paper feed device 39 are disposed the third fixed cassette 25 at the lowest part thereof, the second rotatable cassette 27 and the first rotatable cassette 26, in due order on the third fixed cassette 25. Accordingly, by storing copy paper generally used most frequently (for example copy paper such as size A4 or B5) in the first rotatable cassette 26 which has the shortest transport path to the copying machine among the paper feed means 25, 26, and 27, the shortest transport path is available for both of lateral and longitudinal paper feed, and therefore the transport time of the copy material most frequently used can be shortened.

The following description will discuss the rotational operation of the rotatable section 32 referring to the first rotatable cassette 26. It is assumed that copy paper of, for example, size B5 is stored in the rotatable section 32 of the first rotatable cassette 26, and the rotatable section 32 is located in the lateral feeding position. In this case, since the nut member 37 engaged by the threaded shaft 35 is located at the position $P_1$ shown in FIG. 4, the lateral position sensor $HP_1$ detects that the rotatable section 32 is in the lateral feeding position. As a result, the display on the operation panel display device 56 indicating the first rotatable cassette shows "B5".

In this case, an operation of the rotation key associated with the first rotatable cassette 26 of the operation panel keys 55 permits the level of the output terminal CW of the microcomputer 51 to become high, and the level of the output terminal CCW to become low. As a result, the transistors $Tr_1$ and $Tr_4$ are switched on, a current flows through a dc power source of +24V, the transistor $Tr_1$, the driving motor 36, the transistor $Tr_4$ and the earth wiring, and consequently the driving motor 36 rotates clockwise (in the direction indicated by C in FIG. 2(*a*)). Therefore, since the threaded shaft 35 rotates clockwise, the nut member 37 is moved from $P_1$ to $P_6$ following a sequence ($P_1$, $P_2$, $P_3$, $P_4$, $P_5$ and $P_6$) while the guiding shaft 34 of the rotatable section 32 is moved from $Q_1$ to $Q_6$, making a reciprocating movement following a sequence ($Q_1$, $Q_2$, $Q_3$, $Q_4$, $Q_5$, and $Q_6$) and rotating within the guiding hole 33*a* in the rotatable section support plate 33. The nut member 37 then reaches the longitudinal position sensor $HP_2$, and when it interrupts light in the photointerrupter, the longitudinal position sensor $HP_2$ detects that the rotatable section 32 has been in the longitudinal feeding position. In this state, the driving motor 36 is stopped and the display on the operation panel display device 56 indicating the first rotatable cassette shows "B5R".

In this condition, a successive operation of the rotation key 48 permits the level of the output terminal CCW of the microcomputer 51 to become high, and the level of the output terminal CW to become low. As a result, the transistors $Tr_2$ and $Tr_3$ are switched on, a current flows through the dc power source of +24V, the transistor $Tr_2$, the driving motor 36, the transistor $Tr_3$ and the earth wiring, and consequently the driving motor 36 rotates counterclockwise. Thus, the rotatable section 32 is shifted from the longitudinal feeding position to the lateral feeding position after having a reverse process to the preceding operation. The motor 36 is then stopped when the lateral position sensor $HP_1$ has detected that the rotatable section 32 has been located in the lateral feeding position.

As is aforementioned, a copy material feeding device of the present invention has an arrangement wherein a copy material feeding member with a copy material orientation changing means is disposed in such a position in the device that a transport path from the copy material feeding member with the copy material orientation changing means to the copying apparatus is allowed to be shorter than that from a copy material feeding member without the copy material orientation changing means to the copying apparatus. Therefore, as to the copy paper stored in the copy material feeding member with the copy material orientation changing means, its transport time to the copying apparatus is shortened regardless of its lateral or longitudinal feed. Accordingly, by storing copy material generally used most frequently in the copy material feeding member with the copy material orientation changing means, the transport time of the copy material most frequently used can be shortened. Therefore, the arrangement makes it possible to increase copying speed for the first sheet of copy paper when the copy paper in the copy material feeding member with the copy material orientation changing means is selected to perform a copying operation. As a result, a better operability of copying apparatus is obtained by applying the copy material feeding device of the present invention to the copying apparatus.

In addition, although the present embodiment is discussed referring to copy paper as a copy material, it is not limited to copy paper, but may be other copy materials such as OHP film.

Moreover, those of cassette type copy material feeding members such as fixed cassettes or rotatable cassettes are disclosed in the present embodiment, but any type of copy material feeding members are adoptable as long as the copy material stored therein may be optionally put in or taken out.

The invention being thus described, it may be obvious that the same may be varied in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. An image forming device comprising:

a copying apparatus for copying original sheets;

means for detecting a size and orientation of said original sheets;

a plurality of fixed and rotatable copy material feeding members for supplying copy material to said copying apparatus;

means for storing a most frequently used copy material, said means including a rotatable one of said plurality of fixed and rotatable copy material feeding members;

a plurality of transport paths operatively connecting said copying apparatus to said plurality of copy material feeding members, respectively;

said rotatable copy material feeding member storing the most frequently used copy material being connected immediately adjacent to said copying apparatus by a shortest one of said plurality of transport paths; and control means for selecting one of said plurality of copy material feeding members in response to said means for detecting;

said control means further detecting a supply orientation of the selected rotatable copy material feeding member and selectively changing the supply orientation thereof to correspond to an orientation of said original sheets.

2. The image forming device according to claim 1, further comprising a desk portion as a housing member having a plurality of cassette levels and upon which said copying apparatus is positioned, wherein said plurality of fixed and rotatable copy material feeding members include at lest one fixed cassette fixed in a lateral or longitudinal supply position for supplying copy material to said copying apparatus, and positioned at a lowest level of said desk portion;

a second rotatable cassette, positioned at a second lowest level of said desk portion and having a rotatable section for shifting copy material thereon in either a lateral or longitudinal supply position by rotating the copy material; and a first rotatable cassette, positioned at a highest level of said desk portion and having a rotatable section for storing and supplying the most frequently used copy material.

3. The image forming device according to claim 2, wherein said plurality of transport paths are elongated from inside of said desk portion to a paper stopping roller part of said copying apparatus for synchronizing the supply of copy material, wherein said at least one fixed cassette, said second rotatable cassette and said first rotatable cassette are connected to said plurality of paper transport paths in an ascending order from a lowest level of said desk portion.

* * * * *